United States Patent [19]

McCauley et al.

[11] Patent Number: 4,936,336

[45] Date of Patent: Jun. 26, 1990

[54] TAMPERPROOF CONSTRUCTION FOR HYDRANT ACTUATING NUT

[75] Inventors: Durham S. McCauley, Boston; John K. Waite, Tonawanda; John W. Erwin, Orchard Park, all of N.Y.

[73] Assignee: McGard, Inc., Buffalo, N.Y.

[21] Appl. No.: 428,913

[22] Filed: Oct. 30, 1989

[51] Int. Cl.[5] ..... F16K 35/06; E03B 9/06

[52] U.S. Cl. ..... 137/296; 137/382.5; 137/800; 220/85 P; 220/284; 251/291

[58] Field of Search ..... 137/296, 371, 377, 381, 137/382, 382.5, 800; 215/213, 215; 220/85 P, 284, 285, 286; 251/291, 292

[56] References Cited

U.S. PATENT DOCUMENTS

| | | | |
|---|---|---|---|
| Re. 27,616 | 4/1973 | Diaz | 137/382.5 |
| 2,576,631 | 11/1951 | Mueller et al. | 137/296 |
| 2,762,386 | 9/1956 | Fogle | 137/296 |
| 3,070,115 | 12/1962 | Jester | 137/296 |
| 3,450,148 | 6/1969 | Mongelluzzo et al. | 137/296 |
| 3,453,897 | 7/1969 | Adinolfi | 137/296 |
| 3,709,249 | 1/1973 | Diaz | 137/296 |
| 3,840,041 | 10/1974 | McMurray | 137/296 |
| 3,935,877 | 2/1976 | Franceschi | 137/296 |
| 4,033,372 | 7/1977 | Bowman | 137/296 |
| 4,566,481 | 1/1986 | Leopold, Jr. et al. | 137/296 |
| 4,633,896 | 1/1987 | Bainbridge et al. | 137/296 |
| 4,716,922 | 1/1988 | Camp | 137/296 |

*Primary Examiner*—George L. Walton

*Attorney, Agent, or Firm*—Joseph P. Gastel

[57] ABSTRACT

A tamperproof construction for preventing actuation of the actuating nut of a fire hydrant comprising a nut actuating body for receiving the hydrant nut in turning relationship, set screws locking the nut actuating body to the actuating nut, a shroud permanently secured on the nut actuating body by means of a snap ring so that it covers the set screws but is rotatable on the nut actuating body, a bore in the shroud for permitting selective access to the set screws, a key-operated plug in the bore, a cap permanently and rotatably mounted on an end of the nut actuating body which protrudes through an opening in the shroud, and a limited axial portion of the nut actuating body exposed between the cap and shroud for receiving a specialized wrench.

17 Claims, 3 Drawing Sheets

Fig. 4.
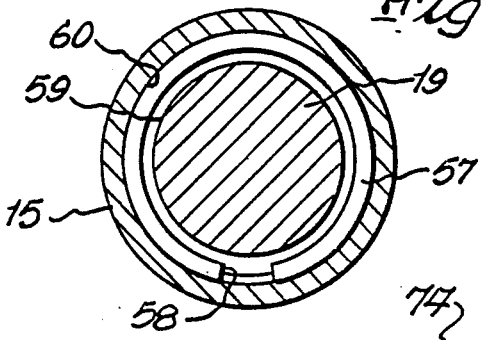
Fig. 7.
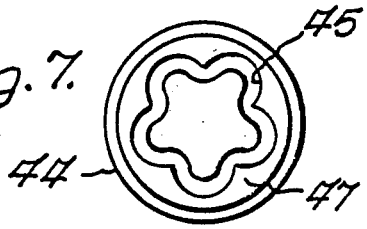
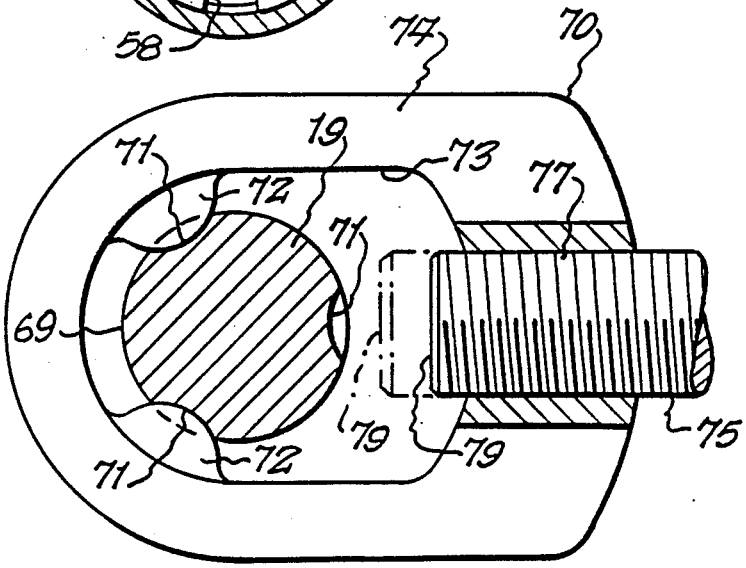
Fig. 5.
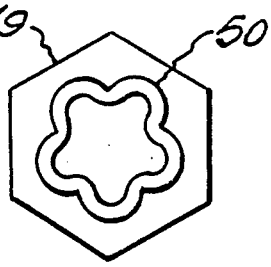
Fig. 8.
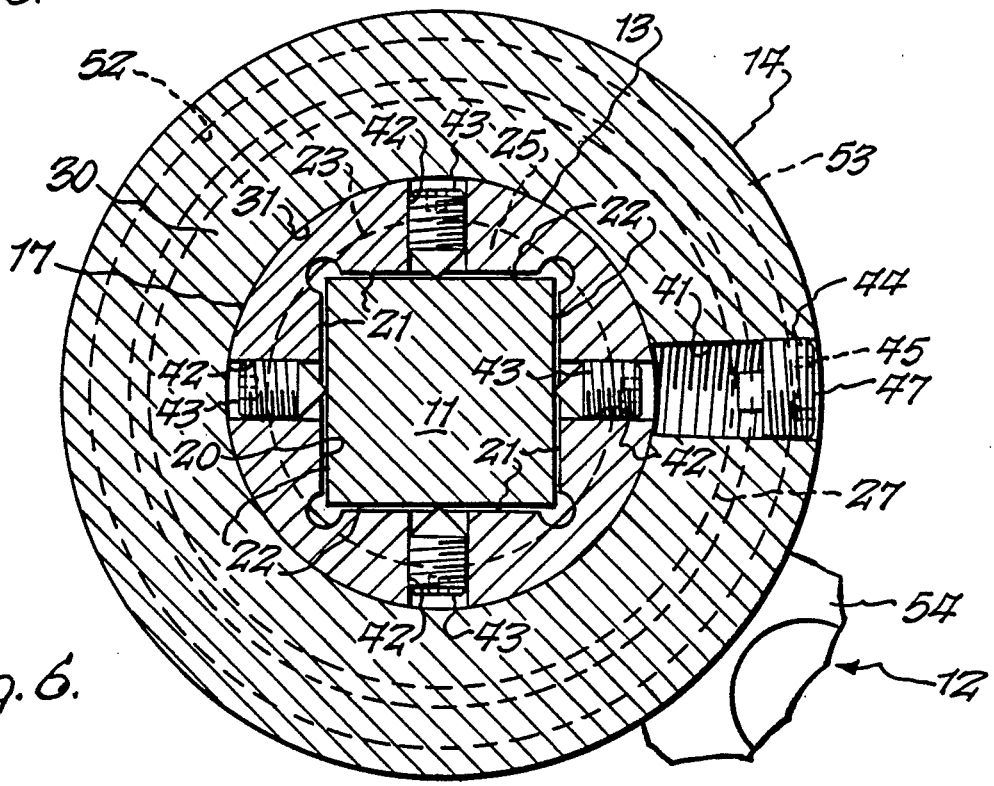
Fig. 6.

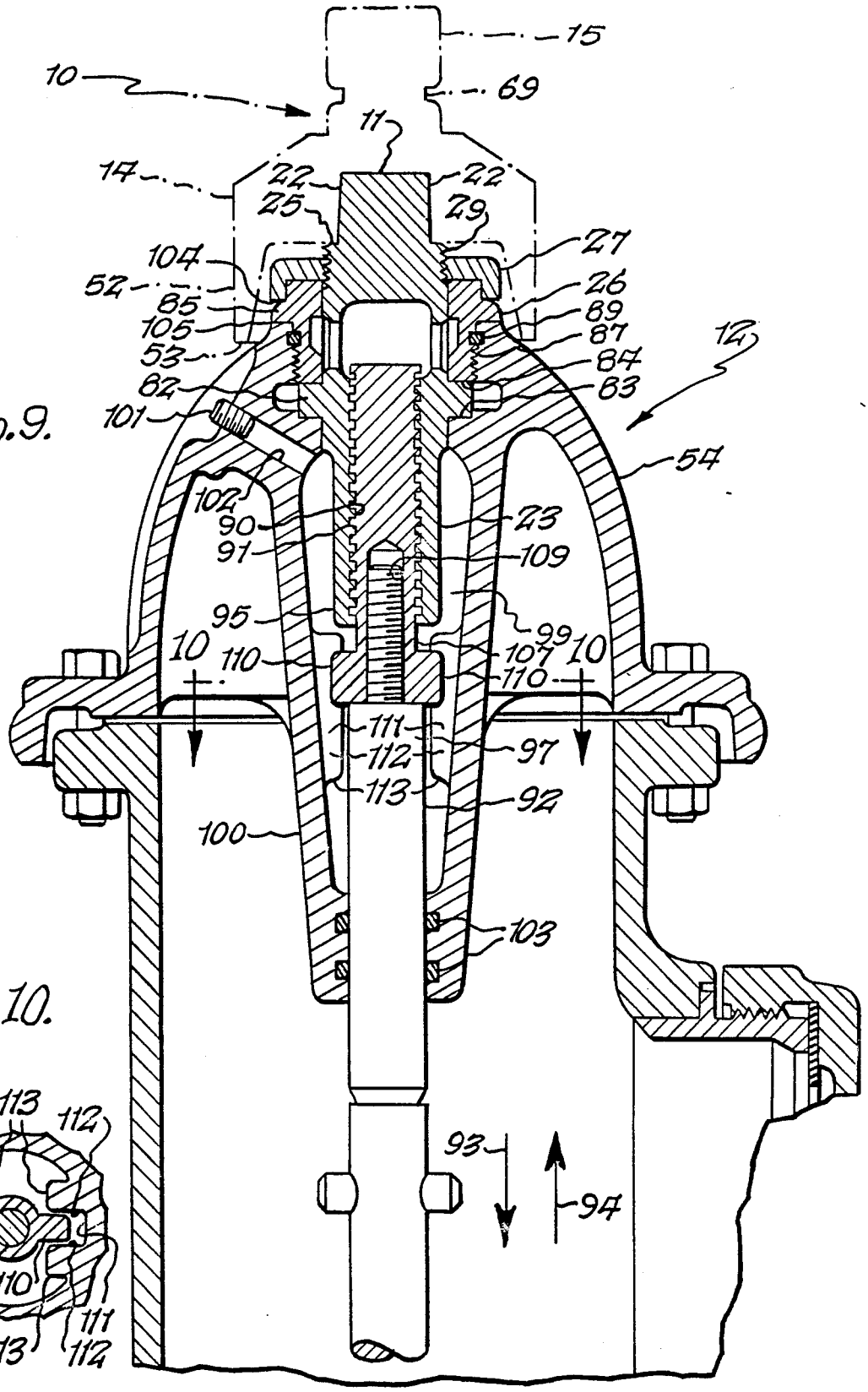
Fig. 9.
Fig. 10.
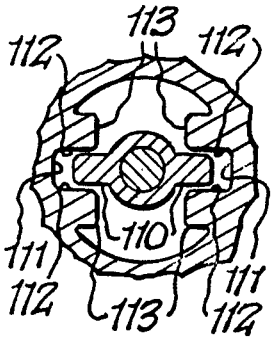

TAMPERPROOF CONSTRUCTION FOR HYDRANT ACTUATING NUT

BACKGROUND OF THE INVENTION

The present invention relates to an improved tamperproof construction for preventing unauthorized turning of the actuating nut of a fire hydrant.

By way of background, unmodified fire hydrants can be opened by anyone having a wrench which can turn the hydrant nut. This results in needless waste of water. In addition, the unauthorized opening of such nuts can result in the accumulation of water in the hydrant above the frost line, and such an accumulation of water, when frozen, can result in damage to the hydrant.

SUMMARY OF THE INVENTION

It is accordingly one object of the present invention to provide an improved tamperproof construction for the actuating nut of a fire hydrant which can be installed easily and simply on a fire hydrant and which can be removed, as is required, by personnel having a proper key structure.

Another object of the present invention is to provide a tamperproof construction for a hydrant nut which not only prevents unauthorized actuation of the fire hydrant but also provides a protective cover to associated portions of the fire hydrant. Other objects and attendant advantages of the present invention will readily be perceived hereafter.

The present invention relates to a construction for rendering tamperproof the shaft actuating polygonal nut of a fire hydrant which extends externally outwardly from a hydrant cover, said construction comprising a nut actuating body having opposite ends, locking means securely locking said nut actuating body to said polygonal nut, a shroud, means rotatably mounting said shroud on one end of said body proximate said hydrant cover, a cap, means rotatably mounting said cap on the opposite end of said body remote from said cover, an exposed space between said cap and said shroud for exposing a limited portion of said body, and means on said limited portion of said body for receiving a wrench.

The various aspects of the present invention will be more fully understood when the following portions of the specification are read in conjunction with the accompanying drawings wherein:

BRIEF DESCRIPTION OF THE DRAWINGS

FIG. 4 is a cross sectional view taken substantially along line 4—4 of FIG. 2 and showing the snap ring which locks the cap to the upper portion of the hydrant nut actuating body;

FIG. 5 is a fragmentary cross sectional view taken substantially along line 5—5 of FIG. 2 and showing the wrench in position on the limited exposed portion of the hydrant nut actuating body of the tamperproof construction;

FIG. 6 is a fragmentary cross sectional view taken substantially along line 6—6 of FIG. 2 and showing the manner in which the set screws provide a locking engagement between the lower portion of the hydrant nut actuating body of the tamperproof construction and the polygonal nut of the fire hydrant;

FIG. 7 is a view taken substantially in the direction of arrows 7—7 of FIG. 3 and showing the face of the plug which has a curvilinear groove therein;

FIG. 8 is a view taken substantially in the direction of arrows 8—8 of FIG. 3 and showing the curvilinear ridge on the key which mates with the curvilinear groove of the plug;

FIG. 9 is a fragmentary cross sectional view of the upper portion of a fire hydrant on which the improved tamperproof construction is to be mounted; and FIG. 10 is a fragmentary cross sectional view taken substantially along line 10—10 of FIG. 9.

DESCRIPTION OF THE PREFERRED EMBODIMENTS

Figures 1, 2, 3:
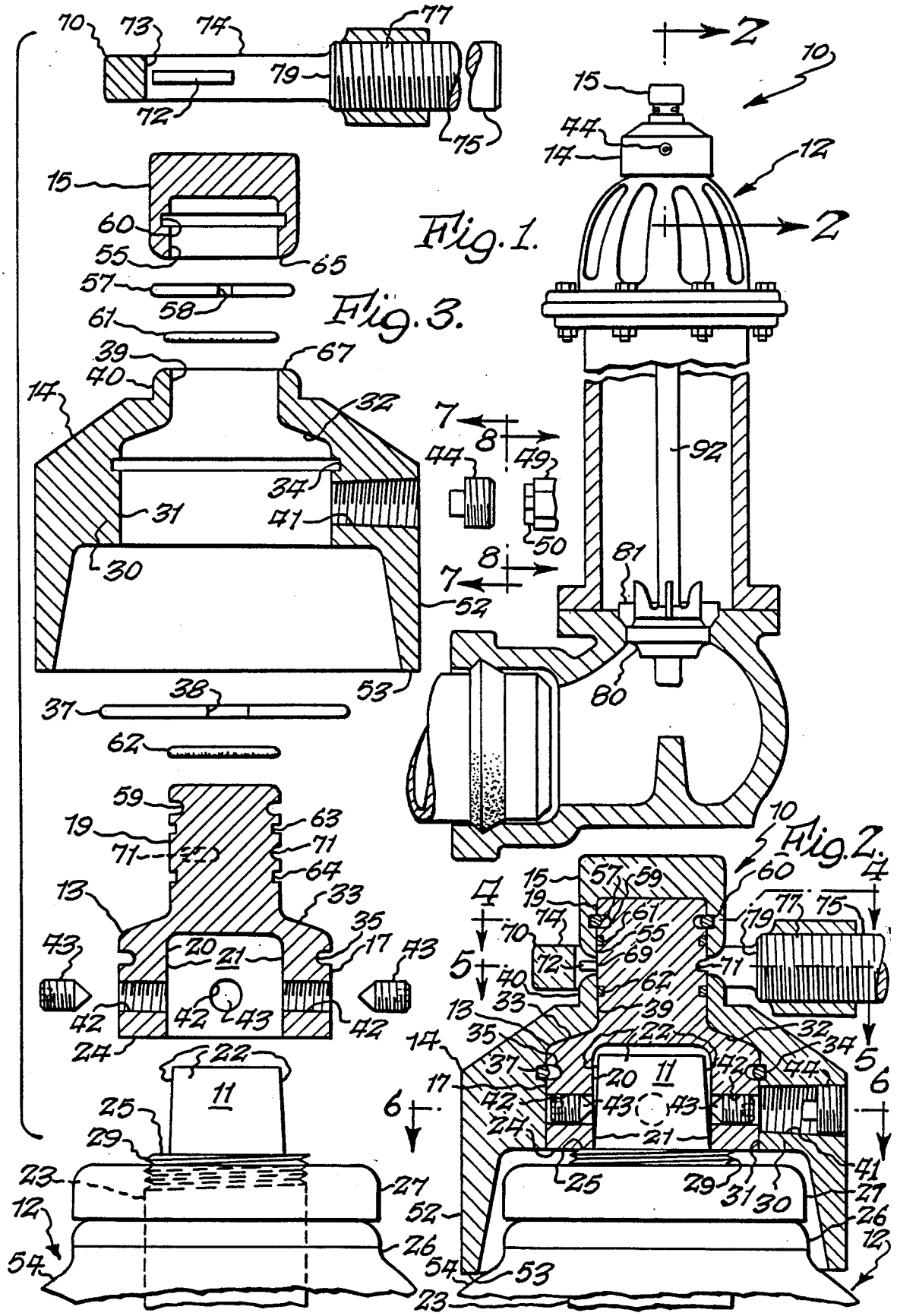
FIG. 1 is a fragmentary side elevational view of the improved tamperproof construction mounted on a fire hydrant.
FIG. 2 is a fragmentary cross sectional view taken substantially along line 2—2 of FIG. 1 and showing the actuating wrench in position on the tamperproof construction.
FIG. 3 is an exploded view showing all of the parts of the tamperproof construction including the wrench, the hole closing plug and the key therefor.

The improved construction 10 for rendering the polygonal nut 11 of a fire hydrant 12 tamperproof against unauthorized actuation includes three basic parts, namely, a hydrant nut actuating body 13, a shroud 14, and a cap 15.

The hydrant nut actuating body 13 includes a first body portion 17 of a first diameter which is larger than a second body portion 19 of a second diameter. The second body portion 19 forms an extension of the first body portion 17. The first body portion 17 includes a polygonal recess 20 (FIGS. 2, 3 and 6) having a plurality of sides 21. Recess 20 receives, in substantially complementary mating relationship, polygonal nut 11 having faces 22, which is located at the end of tubular member 23. Face 24 of body portion 17 abuts the shoulder 25 on tubular member 23 which is of at least as large diameter as the diagonal dimension of nut 11 (FIG. 6). Dust cover 27 is mounted on tubular member 23 by threads 29.

Shroud 14 is permanently assembled on nut actuating body 13, and it is rotatable relative thereto. Shroud 14 includes an annular portion 30 having a cylindrical recess 31 therein which receives nut actuating body portion 17 in contiguous mating relationship. Annular shoulder 32 (FIG. 3) within shroud 14 is abutted by annular shoulder 33 of body 13 when the two are in complementary mating relationship. A first annular groove 34 is located in the wall of recess 31, and a second annular groove 35 is located in body portion 17. A snap ring 37 (FIGS. 2 and 3) holds body 13 and shroud 14 in assembled permanently locked relationship while permitting relative rotation therebetween. Snap ring 37 is of conventional spring steel construction with a gap 38 between the ends thereof. Thus snap ring 37 can be pressed to a smaller diameter so that it can be inserted into groove 35, and when thus assembled, body portion 13 is inserted into shroud 14 until it assumes the position of FIG. 2 whereupon ring 37 snaps outwardly to assume the position of FIG. 2. Once thus assembled, the parts cannot be separated. As can be seen from FIG. 2, body portion 19 of body 13 extends through opening 39 in neck 40 of shroud 14 when the two are in their final assembled relationship. A radial threaded bore 41 extends through annular portion 30 of shroud 14 and can be placed into alignment with the four threaded bores 42 (FIGS. 3 and 6) in body portion 17 of nut actuating body 13 when shroud 14 is rotated on nut actuating body 13. A plurality of set screws 43 are threadably received in bores 42 of nut actuating body 13.

To complete the assembly of the construction for rendering nut 11 tamperproof against unauthorized actuation, cap 15 is permanently rotatably mounted on upper body portion 19. In this respect, cap 15 includes a recess 55 which receives body portion 19 in substantially complementary mating relationship and is permanently secured thereto by a snap ring 57 which fits between annular groove 59 in body portion 19 and annular groove 60 in cap 15. Ring 57 is of conventional spring steel construction and it has a gap 58 between the ends thereof which permits it to be compressed to fit into groove 59, and after body portion 19 is inserted into recess 55, ring 57 expands to lie in grooves 59 and 60 as shown in FIG. 2. The assembly is permanent, and thus cap 15 can be rotated but cannot be removed from body portion 19 of body 13. O-ring seals 61 and 62 fit in annular grooves 63 and 64 of body portion 19 for providing seals with cap 15 and neck 40 of shroud 14.

In operation, the assembly consisting of nut actuating body 13 and cap 15 and shroud 14 both permanently rotatably mounted thereon is installed on polygonal nut 11 by merely sliding it axially thereon so that nut 11 is received in complementary mating relationship within recess 20. Thereafter, shroud 14 is rotated on body 13 so that bore 41 is aligned with one of the tapped bores 42, and the associated set screw 43 is then threaded into this bore 42 and brought into tight locking engagement with one of the sides 22 of polygonal nut 11. Thereafter, shroud 14 is rotated on body 13 until bore 41 is in alignment with another of the bores 42 in body 13, and another set screw 43 is screwed into its associated bore 42 until it is in tight engagement with another side 22 of nut 11. This operation is repeated until each of the set screws 43 in each of the bores 42 are in locking engagement with each of the sides 22 of the polygonal nut. It can thus be seen that body portion 17 is now locked to polygonal nut 11. Set screws 43 are preferably sufficiently hard so that their pointed ends tend to dig into nut 11. Also, if desired, depressions may be formed in the sides 22 of nut 11 to receive the ends of set screws 43. Set screws 43 have hexagonal bores therein for receiving a hexagonal wrench.

A plug 44 is provided with a curvilinear groove 45 (FIG. 7) in face 47 thereof. A key 49 is provided with a mating curvilinear ridge 50. Thus, when plug 44 is tightened into tapered threaded bore 41 with key 49, it cannot be removed except with a mating key, and thus there can be no unauthorized access to set screws 43. Shroud 14 has an annular skirt 52 which encloses dust seal 27 of hydrant 12, neck 26 of hydrant cover 54, and a portion of hydrant cover 54. The lower annular edge 53 of skirt 52 is located extremely close to hydrant cover 54 so that access cannot be had to the enclosed hydrant portions within skirt 52.

The lowermost annular edge 65 of cap 15 is spaced from the annular edge 67 of neck 40. This leaves a limited annular portion 69 (FIG. 2) of nut actuating body portion 19 exposed for receiving a wrench 70. Limited annular portion 69 (FIG. 5) has a plurality of equally spaced shallow grooves 71 therein for receiving projections 72 which are formed on wrench head 74 and project into opening 73 of the wrench head which is threadably secured to an elongated shaft 75 by means of a threaded connection at 77. Opening 73 in wrench head 74 is sufficiently large so that the wrench head 74 can pass over cap 15 until projections 72 are in the same plane as grooves 71. Thereafter, the wrench handle 75 is threadably tightened to move end 79 from its solid line position in FIG. 5 to its dotted line position therein so that projections 72 are received in two of the three grooves 71 and end 79 abuts the adjacent portions of cap 15 and neck 40 of shroud 14, as can be visualized from FIG. 2. At this time there is a locked connection between nut actuating body 13 and wrench 70 which can then be turned to turn nut 11 and thus actuate tubular member 23 to open a valve 80 in fire hydrant 12. Valve 80 of the fire hydrant is of the same construction as that shown in U.S. Pat. No. 4,633,896 which is incorporated herein by reference. Briefly, when nut 11 is rotated for opening valve 80, shaft 23 moves downwardly to move valve 80 away from its seat 81, and vice versa. After the nut 11 has been turned to open the valve, it can be turned to close the valve, and thereafter handle 70 can be unthreaded from head 74 so that the wrench can be moved upwardly over cap 15 and removed.

The improved tamperproof construction of the present invention is especially desirable for use on the type of hydrant shown in FIG. 9, although it can be used with any type of hydrant. More specifically, as noted above, nut 11 is located at the end of tubular member 23 which has an annular flange 82 received between shoulder 83 of hydrant cover 54 and the end 84 of sleeve 85 which is threaded into hydrant cover 54 at 87. An O-ring 89 provides a seal between sleeve 85 and hydrant cover 54. Thus, when nut 11 is rotated, tubular member 23 will rotate without moving axially. Tubular member 23 is threaded internally at 90 and it receives threads 91 at the end of valve actuating shaft extension member 107 which is attached to valve actuating shaft 92 at threaded connection 109. Shaft extension member 97 has diametrically opposed wings or flanges 110 which ride in grooves 111 located between shoulders 112 formed on abutments 113 on the inside of housing 100. Thus, when nut 11 is rotated, shaft 92 can move axially in the direction of arrow 93 to open valve 80 or it can move in the direction of arrow 94 to close valve 80. The wings 110 which are located in grooves 111 prevent shaft 92 from rotating with tubular member 23.

The lower end portion 95 of tubular member 23 and the upper portion 97 of shaft 92 are located within chamber 99 of housing 100 which is an internal extension of hydrant cover 54. Chamber 99 is filled with oil to provide lubrication for the threaded connection at 90–91. The lubricant can be supplied to chamber 99 by removing plug 101 from the end of bore 102 which extends through hydrant cover 54 and is in communication with chamber 99. Thus, chamber 99 can be filled with lubricant periodically, as required. O-rings 103 provide seals between shaft 92 and housing 100.

As can be seen from FIG. 9, not only does the tamperproof construction 10 of the present invention prevent unauthorized turning of nut 11, but, in addition, it overlies dust cover 27 and the exposed portion of sleeve 85 to thereby prevent unauthorized access to the latter two items. In addition, shroud 14 acts as a supplemental dust cover to prevent exposure of the seams 104 and 105 to dirt, grime and other foreign elements. If desired, skirt 52 can be extended to overlie plug 101, to thereby also prevent access to bore 102.

While a square polygonal nut 11 has been shown, it will be appreciated that the tamperproof construction can be utilized with a nut of any polygonal cross section, such as one which is pentagonal. All parts of the tamperproof structure 10 are fabricated from hardened steel having a corrosion resistant coating. These parts cannot be chiseled or defaced sufficiently to enable unauthorized turning of the hydrant unit.

While preferred embodiments of the present invention have been disclosed, it will be appreciated that it is not limited thereto but may be otherwise embodied within the scope of the following claims.

What is claimed is:

1. In a fire hydrant having a hydrant shaft with, valve-actuating polygonal nut at the end thereof extending externally outwardly from a hydrant cover, a construction for rendering the nut tamper proof against unauthorized actuation comprising a nut actuating body having a first body portion with a first recess therein for receiving said polygonal nut in turning relationship, first locking means in said first body portion for securing said first body portion to said polygonal nut against removal therefrom, a second body portion which is coaxial with said first body portion and extends outwardly from said first body portion, a shroud, a second recess in said shroud for rotatably receiving said first body portion, second locking means for locking said shroud to said first body portion against removal therefrom while permitting relative rotation therebetween, an opening in said shroud for permitting said second body portion to project therethrough and extend beyond said shroud, a cap, a third recess in said cap for receiving said second body portion, third locking means extending between said cap and said second body portion for locking said cap to said second body portion while permitting relative rotation therebetween, a space between said cap and said shroud for permitting exposure of a limited portion of said second body portion, and means on said limited portion of said second body portion for receiving a wrench for turning said nut actuating body and thus turning said polygonal nut and hydrant shaft.

2. In a fire hydrant as set forth in claim 1 wherein said first locking means comprises screw means extending between said first body portion and said polygonal nut.

3. In a fire hydrant as set forth in claim 2 including bore means in said shroud for permitting access to said screw means.

4. In a fire hydrant as set forth in claim 3 including a threaded plug in said bore means, and a key for turning said threaded plug.

5. In a fire hydrant as set forth in claim 4 wherein said screw means comprise a plurality of screws with each of said screws for effecting a locking engagement with a different side of said polygonal nut.

6. In a fire hydrant as set forth in claim 5 wherein said bore means comprises a single bore, said shroud being rotatable for aligning said single bore with each of said screws.

7. In a fire hydrant as set forth in claim 5 wherein said screws comprise set screws.

8. In a fire hydrant as set forth in claim 1 including a skirt on said shroud extending beyond said first body portion and overlying a portion of said hydrant cover and terminating in contiguous relationship to said hydrant cover so as to obstruct access to said first body portion.

9. In a fire hydrant as set forth in claim 1 wherein said second locking means comprise a snap ring.

10. In a fire hydrant as set forth in claim 1 wherein said third locking means comprise a snap ring.

11. In a fire hydrant as set forth in claim 10 wherein said second locking means comprise a second snap ring.

12. In a fire hydrant having a hydrant shaft with a shaft-actuating polygonal nut at the end thereof extending externally outwardly from a hydrant cover, a construction for rendering said nut tamperproof against unauthorized actuation comprising a nut actuating body having opposite ends, locking means securely locking said nut actuating body to said polygonal nut, a shroud, means rotatably mounting said shroud on one end of said body proximate said hydrant cover, a cap, means rotatably mounting said cap on the opposite end of said body remote from said cover, an exposed space between said cap and said shroud for exposing a limited portion of said body, and means on said limited portion of said body for receiving a wrench for turning said nut actuating body and thus turning said polygonal nut and hydrant shaft.

13. In a fire hydrant as set forth in claim 12 including means on said shroud for permitting selective access to said locking means for removing and installing said nut actuating body relative to said polygonal nut.

14. In a fire hydrant as set forth in claim 13 wherein said body, shroud and cap comprises an assembly, and second locking means securing said assembly in permanently assembled relationship.

15. In a fire hydrant as set forth in claim 14 wherein said second locking means comprises a first snap ring between said shroud and said body, and a second snap ring between said cap and said body.

16. In a fire hydrant as set forth in claim 12 wherein said nut is located at the end of a tubular member which threadably engages said hydrant shaft for effecting axial movement thereof and wherein said fire hydrant includes a dust cover at the end of said hydrant cover and encircling said tubular member proximate said nut, and wherein said shroud includes a skirt which encircles said dust cover and terminates beyond said dust cover.

17. In a fire hydrant as set forth in claim 16 wherein said skirt terminates in contiguous relationship to said hydrant cover to prevent access to said dust cover.

* * * * *